US005620229A

United States Patent [19]

Ledford

[11] Patent Number: 5,620,229

[45] Date of Patent: Apr. 15, 1997

[54] COMBINATION CARRYING BAG, COVER AND ACCESSORY STORAGE FOR A PORTABLE FOLDING LOUNGE

[76] Inventor: Janet K. Ledford, P.O. Box 1108, Duncan, Okla. 73534

[21] Appl. No.: 629,841

[22] Filed: Apr. 10, 1996

[51] Int. Cl.[6] ..... A47C 27/00

[52] U.S. Cl. ..... 297/229; 297/183.5; 297/188.04; 297/188.01

[58] Field of Search ..... 297/228.11, 228.13, 297/223, 224, 225, 380, 381, 382, 45, 31, 16.2, 229, 183.1, 183.5, 183.6, 188.01, 188.04, 188.05, 188.06, 188.07, 188.08, 452.13, 219.1, 228.12, 228.1

[56] References Cited

U.S. PATENT DOCUMENTS

| | | | |
|---|---|---|---|
| 94,448 | 8/1869 | Simonson | 297/188.04 |
| 2,973,888 | 3/1961 | Beardsley | 297/380 X |
| 4,877,288 | 10/1989 | Lee | 297/229 |
| 4,892,353 | 1/1990 | Goddard | 297/224 |
| 5,150,945 | 9/1992 | Aupperlee et al. | 297/229 X |
| 5,205,610 | 4/1993 | Reninger | 297/380 |
| 5,295,732 | 3/1994 | Boisset | 297/188.04 X |
| 5,326,152 | 7/1994 | Baron | 297/229 |
| 5,507,556 | 4/1996 | Dixon | 297/188.04 X |

FOREIGN PATENT DOCUMENTS

| | | | |
|---|---|---|---|
| 260182 | 3/1988 | European Pat. Off. | 297/188.07 |

*Primary Examiner*—Milton Nelson, Jr.
*Attorney, Agent, or Firm*—Thomas R. Weaver

[57] ABSTRACT

An article of manufacture useful to cover and bag a portable folding lounge of the type usually associated with sun bathing and casual uses is provided. The article, which is a flexible material detachably fitted to the lounge, is adapted to transport and store the lounge and personal items employed in the use of the lounge by a person reclining thereon. The article provides a uniform surface upon which a user may recline as well as a bag which fully encloses the lounge upon folding for subsequent storage and transport.

15 Claims, 3 Drawing Sheets

4
14
24
6
12
8
40
46
44
38
48
42
36
60
62
58
56
2

18
36
46
40
10
54
22
52
50
24
28
6
20
30
32
26
16
34

COMBINATION CARRYING BAG, COVER AND ACCESSORY STORAGE FOR A PORTABLE FOLDING LOUNGE

TECHNICAL FIELD OF THE INVENTION

This invention broadly relates to a furniture cover. The invention more particularly relates to a cover for a chair or seat of the type ordinarily employed by a reclining or seated person at a beach, a swimming pool, a sun deck, a picnic or at some other such recreational, casual or informal activity. Such furniture is known in the art, and is referred to herein, as a lounge or beach chair. The lounge of the type referred to herein is well known in the art, is ordinarily relatively low in weight and is adapted to be easily folded for storage and/or transport to and from the intended place of use. Such a lounge is specifically referred to herein as a portable folding lounge.

The invention more specifically, is a combination flexible cover and bag for a portable folding lounge in both the unfolded condition and the folded condition.

DESCRIPTION OF THE PRIOR ART AND PROBLEMS SOLVED

It is a well known and common practice for a person reclining outside in the sun to employ a portable folding lounge upon which to lie whereby the body is supported by the lounge at a distance above the surface of the ground. Such activity, in addition to the use of the lounge itself, ordinarily involves the use of various personal items and accessories, such as towels, skin lotion and skin cream, books, dark glasses, drink containers, shorts and other articles of attire. The lounge and the various items involved in the activity present a logistics problem merely in carrying the lounge and accessories to and from the desired use site. Such carrying can involve multiple trips and/or multiple bags and, as such, is inconvenient and burdensome.

Furthermore, portable folding lounges commonly in use feature surfaces comprised of parallel bands, net or woven straps upon which the user reclines. Such a surface provides non-uniform support to thereby create pressure marks, sometimes called striping or welts, on the skin of the recliner and are not comfortable. To allay this problem, a recliner often places a towel on the surface of the lounge to provide a more uniform surface upon which to lie. It will be appreciated that a towel, thus employed, has a tendency to be blown off the lounge and become either lost, or at least dirty, and requires more than little attention to the management thereof.

The above problems are solved by this invention which provides a flexible cover and a bag for a portable folding lounge. The cover provides a uniform surface to support the body of the recliner, is adapted to serve as a storage site for personal items and accessories employed during the recreational use of the lounge and serves as a bag for the lounge. In this regard, the cover converts to a bag for holding and carrying the lounge in the folded condition, wherein the conversion from cover to bag occurs upon the mere folding of the lounge.

This invention thus provides a flexible cover for a portable folding lounge comprising a surface upon which a person lies when the lounge is in the unfolded position and a bag in which to store the lounge and the various personal items and accessories when the lounge is in the folded position. The bag also enables a person to carry the folded lounge and various other items in a single unit to thereby eliminate multiple loads and/or multiple trips.

SUMMARY OF THE INVENTION

By this invention there is provided an article of manufacture being, in combination, a cover and a bag for and a tool employed in a method of transporting a portable folding lounge together with associated items used with the lounge.

The bag of this invention is fitted to and covers the entire top surface of the lounge and is partially fitted to and partially covers the bottom surface of the lounge. The bag, when the lounge is in an unfolded position for use by a recliner, is adapted to provide a surface upon which to recline as well as to provide storage for items useful to the recliner. The bag, when the lounge is in the folded position for transport, is adapted to hold and maintain the lounge in folded position. The lounge may be folded and unfolded without the necessity of removing the bag from its fitted position on the lounge.

DESCRIPTION OF THE PREFERRED EMBODIMENTS

Figure 1:
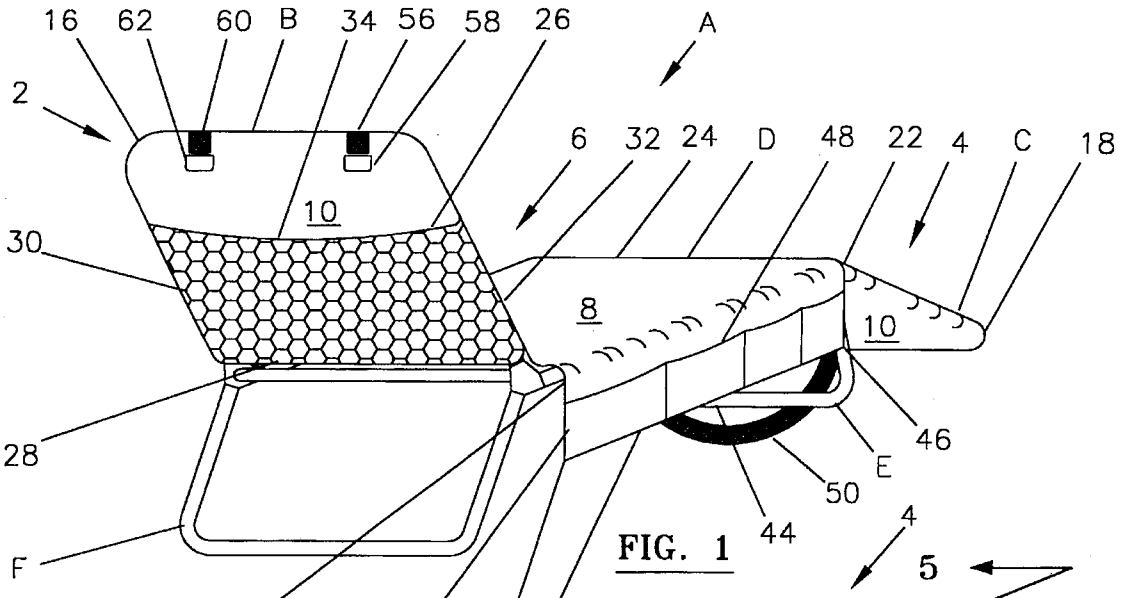
FIG. 1 is a modified isometric view of a portable folding lounge, referred to herein as a "lounge," of the type usually associated with casual use at a beach or swimming pool. The view depicts the lounge in one unfolded position of use wherein one end is raised and one end is lowered. The lounge is covered by the CARRYING BAG. COVER AND ACCESSORY STORAGE article of this invention.
Figure 2:
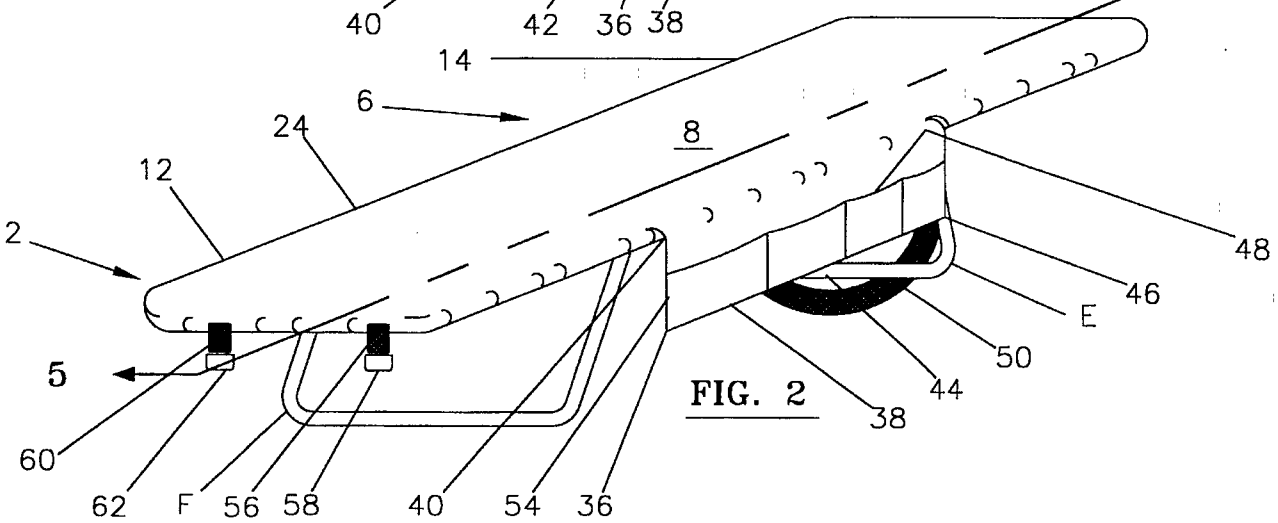
FIG. 2 is the lounge of FIG. 1 in another unfolded position of use wherein both ends are horizontal. The lounge is covered by the CARRYING BAG, COVER AND ACCESSORY STORAGE article of this invention.
Figures 3, 4:
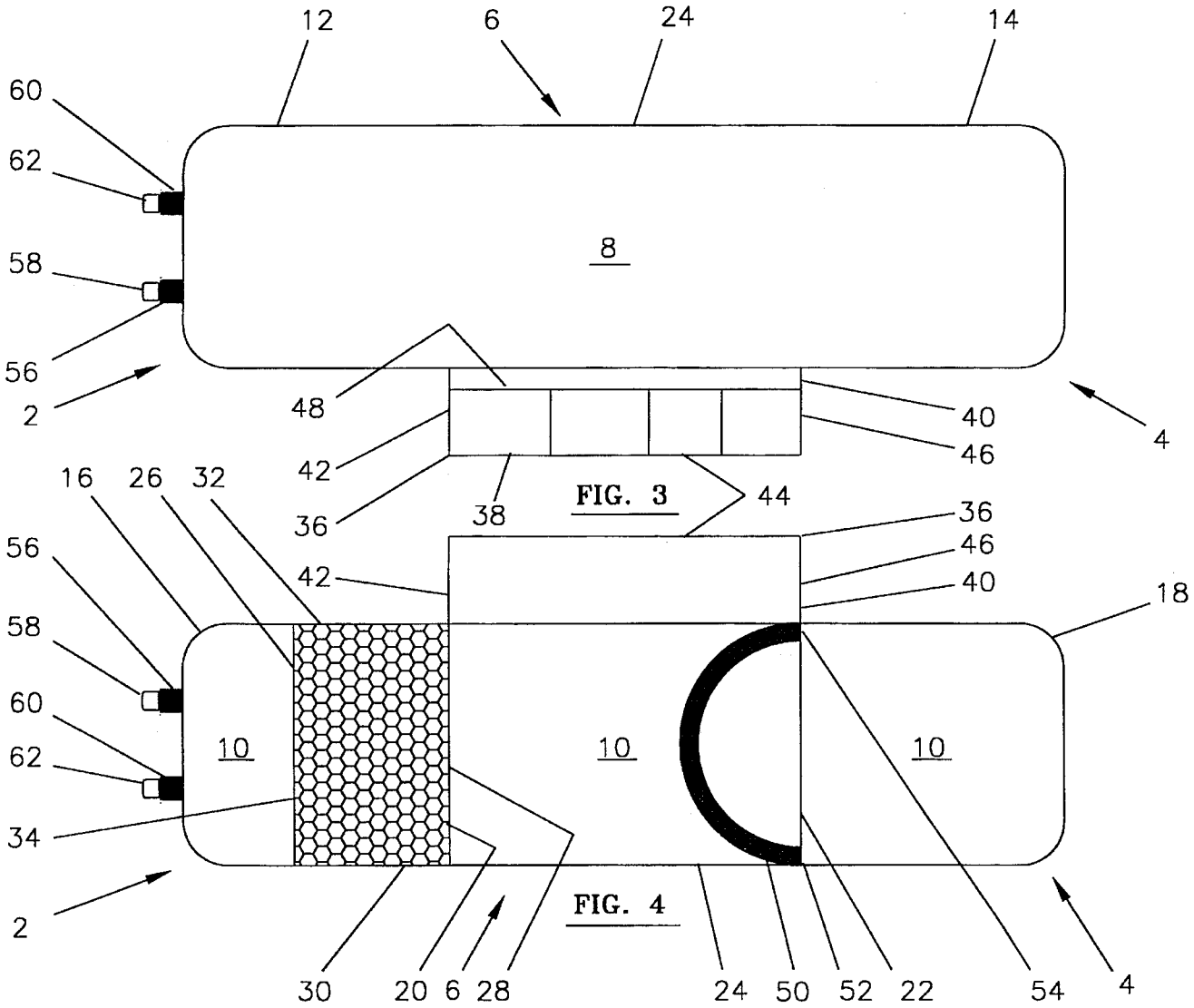
FIG. 3 is a top plan view of FIG. 2 showing the top surface of the cover of this invention.
FIG. 4 is a bottom plan view of FIG. 2 showing the bottom surface of the cover of this invention.
Figure 5:
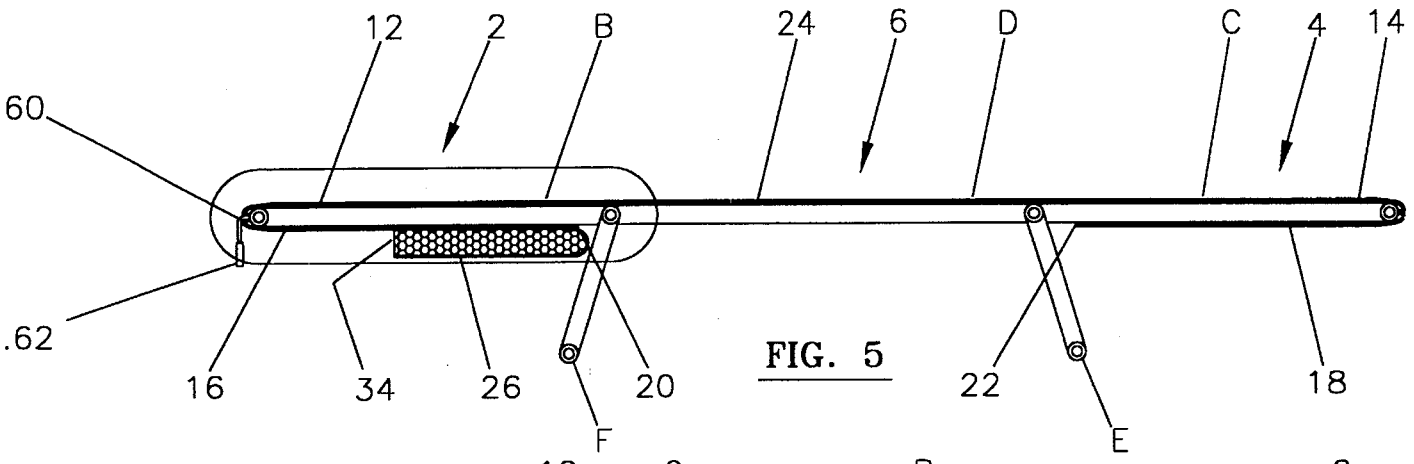
FIG. 5 is a modified longitudinal section view of FIG. 2 taken in the direction of arrows 5 as shown in FIG. 2.
Figure 6:
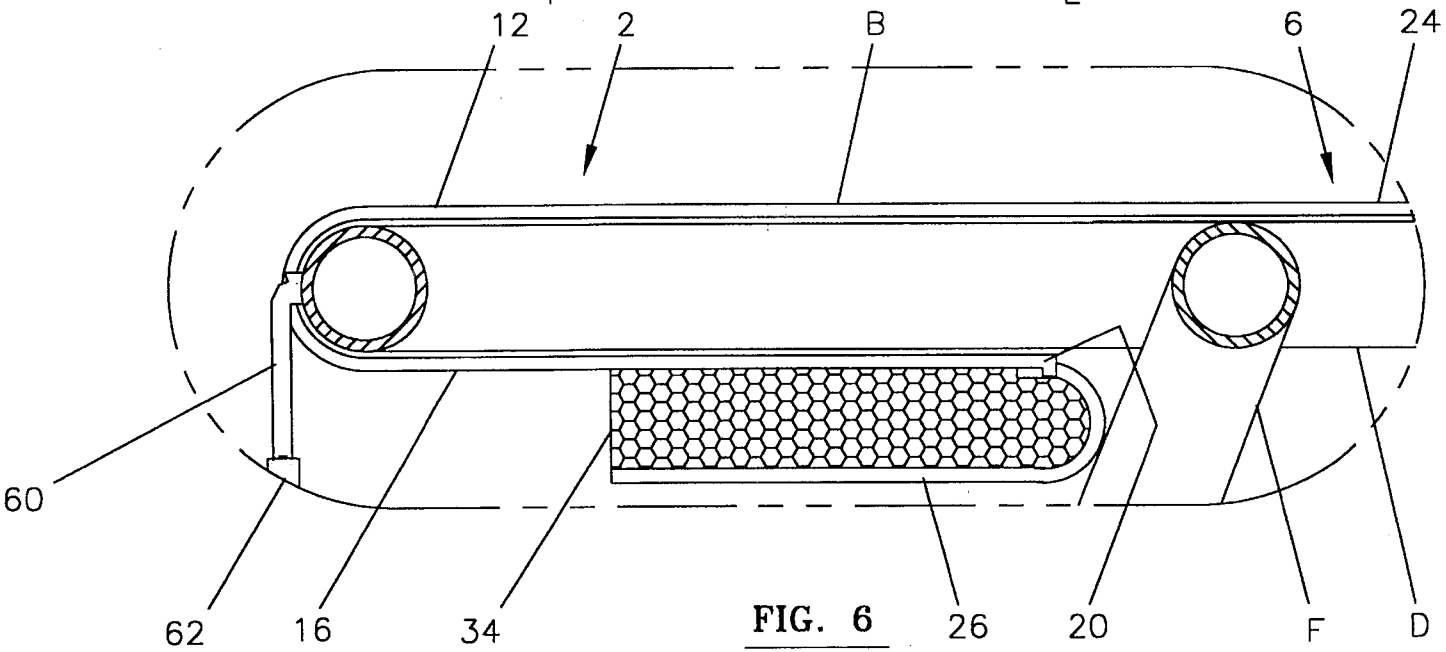
FIG. 6 is an expanded view of a portion of FIG. 5 which shows a detail of the cover of this invention.

Referring now to FIGS. 1–6. lounge structure A is shown, for example, in FIG. 1 as comprising first folding portion B, second folding portion C, stationary center portion D, intermediate and hingedly attached to said first and said second folding portions, and folding legs E and F, hingedly attached to center portion D.

The cover of this invention, shown installed on lounge A, is comprised of first end sleeve section 2, second end sleeve section 4, and trunk section 6, intermediate said first sleeve section and said second sleeve section. For purposes of this description, first end sleeve section 2 is the "head" end, and second end sleeve section 4 is the "foot" end. Thus, the head end of the cover of this invention substantially completely covers folding portion B of lounge A, the foot end of the cover of this invention substantially completely covers folding portion C of lounge A and trunk section 6 of the cover of this invention substantially completely covers the top of stationary center portion D of lounge A.

First sleeve section 2, second sleeve section 4, and trunk section 6, join and/or are connected to form a rectangular flexible article having top surface 8 and bottom surface 10. Each of sleeves 2 and 4 is comprised of a flexible rectangular top layer 12 and 14, respectively, which corresponds with, overlies and is attached to a flexible rectangular bottom layer 16 and 18, respectively, along each common longitudinal edge and each common outside transverse edge to thereby form each said sleeve whereby first sleeve section 2 has one inwardly facing open side 20 and second sleeve section 4 has one inwardly facing open side 22.

Trunk section 6 is comprised of a single flexible rectangular layer 24 wherein each transverse edge of layer 24 is attached or otherwise joined to the inner transverse edge of top layers 12 and 14 of sleeves 2 and 4. From the above, it is evident that top layers 12 and 14 of sleeve sections 2 and 4, and layer 24 of trunk section 6 cooperate to form top surface 8 of the cover of this invention.

It is within the scope of this invention, and a preferred embodiment thereof, that flexible layers 12, 14 and 24 are, in fact, a single, continuous layer. It is also within the scope of this invention, and a preferred embodiment thereof, that flexible layers 12, 14, 16, 18 and 24 are, in fact, a single, continuous layer.

The flexible layers 12, 14, 16, 18 and 24 are preferably constructed of a flexible fabric material which is water repellent, mildew resistant, color fast, and fade resistant; furthermore, the material has high tensile strength, satisfactory scratch and tear resistance, is durable and has low porosity and low permeability. It is believed that materials which exhibit the above qualities include fabrics made of materials selected from nylon thread having a weight in the range of from about 70 to about 500 denier, 7 to 14.5 ounce cotton cloth, blends of nylon and cotton, oxford cloth and canvas cloth.

To assist in obtaining, or to otherwise enhance, the described physical, chemical and mechanical properties of the materials, such materials may also be coated with a suitable polymeric material, such as polyurethane. Such coating is optional as to materials made exclusively of nylon. It is preferred that the other named materials be coated.

The various layers of fabric which comprise the cover/bag of this invention can be joined together by any means known in the art. Some such suitable means of attachment include, but are not limited to, sewing and thermal fusing. Sewing methods include straight stitch, serging, and single and double stitch roll hemming. Threads used in sewing methods referred to herein are preferably T70 to T135 nylon.

The bottom surface 10 of flexible layer 16 of first sleeve section 2 has attached thereto a pocket 26 having three closed sides 28, 30, 32 and one outwardly facing open side 34. Pocket 26 is comprised of a net material which is attached to bottom flexible layer 16 adjacent to each common longitudinal edge and each common inner transverse edge. The net material of pocket 26 is comprised of an open weave construction adapted to maximize the circulation of air through pocket 26 and any contents thereof for the purpose of drying contents which may be damp or wet. It will be appreciated that the intent of the construction of pocket 26 is to prevent, or at least to minimize, the formation of mildew on the contents of the pocket.

Nylon or polyester thread having a weight in the range of from about 70 to about 200 denier is preferably used in the construction of the mesh used in pocket 26.

Trunk section 6 has attached thereto along a longitudinal edge thereof rectangular bag 36 having at least one compartment. It can be seen, for example, in FIG. 1 that bag 36 includes four compartments, each of which is easily accessible by a person reclining on lounge A. Bag 36 is comprised of outside flexible layer 38 attached along each transverse edge and a longitudinal edge thereof to inside flexible layer 40 to thereby form bag 36 having three closed sides 42, 44 and 46 and one open side 48 adjacent to trunk section 6. It is within the scope of this invention, and a preferred embodiment thereof, that flexible layers 24 and 40 are, in fact, a single, flexible layer.

The materials of construction and the various attachment means applicable to layers 38 and 40 are the same as previously described with respect to layers 12, 14, 16, 18 and 24.

The bottom surface 10 of flexible layer 18 of second sleeve section 4 has attached thereto web belt 50 which is fastened, preferably by sewing, at end 52 and end 54 thereof, to the points of intersection of each longitudinal edge and the transverse edge of flexible layer 18 adjacent to inwardly facing open side 22 to thereby form a semi-circular loop. Web belt 50 is, preferably, one of nylon or polypropylene having a width sufficient to comfortably serve as a handle or shoulder strap. It is believed that a strap having a width in the range of from about 0.5 to about 2 inches is satisfactory for the intended use.

Flexible layer 16 of first sleeve section 2 has attached thereto at the outside transverse edge thereof, preferably by sewing, one end of web strap 56 and one end of web strap 60. Web strap 56 and web strap 60 are spaced apart along the said transverse edge. The materials of construction and dimensions of straps 56 and 60 are as described with regard to belt 50. Cloth clamps 58 and 62 are attached to the opposite ends of straps 56 and 60, respectively. The cloth clamps can be of all plastic construction, or plastic with metal springs, or all metal.

OPERATION OF THE INVENTION

In operation, the cover of this invention is initially installed on lounge A by inserting first folding portion B into the head end of the cover and inserting second folding portion C into the foot end. This operation is preferably conducted by first placing folding portions B and C in positions vertical to stationary center portion D, placing the head end and foot end over the respective folding portions and then placing the folding portions in some desired reclining position as shown, for example, in FIGS. 1 and 2.

The flexible layer of top surface 8 may not be of a type which some reclining users prefer to contact. Accordingly, a material more preferable to such users, such as a cotton towel, may be spread on top surface 8. The spread fabric can be detachably secured to the cover by Web straps 56 and 60 and cloth clamps 58 and 62. As will be appreciated, straps 56 and 60 are made of a flexible material and will bend over the edge of folding portion B to enable a spread fabric, such as cotton towel, to be held in place on top surface 8.

It will be appreciated that bag 36 is used as a convenient off-ground storage site for any of various small items which could be of use to a reclining user. Such items could include a cell phone sun tan lotion, magazines and even articles of clothing like sandals and other apparel.

Pocket 26, being comprised of a net material attached to bottom flexible layer 16 and out of immediate contact with a reclining user, is very useful as a storage and/or transport bag for items such as towels or clothing that are wet and/or of a nature not suited for storage and/or transport in bag 36.

When lounge A is to be folded and transported after completion of its use as a recliner, the cover of this invention serves as a bag for and means of carrying it and the various items used by the recliner. Thus, bag 36 (and its contents) is rotated over top surface 8 along the longitudinal edge of trunk section 6 whereby flexible layer 38 is placed in contact with top surface 8.

Then, folding section C is folded inwardly toward and placed in contact with stationary center portion D. By this action the surface of flexible layer 14 is caused to be placed in contact with the surface of flexible layer 24 and the semi-circular loop consisting, of web belt 50, as fastened at end 52 and end 54, is caused to protrude outwardly and away from lounge A to enable its eventual use as a carrying handle or shoulder strap. Thereafter, folding section B is folded inwardly toward and placed in contact with folding section C which is at this time folded against center portion D as above described. By this action the surface of flexible layer 12 is caused to be placed in contact with the surface of flexible layer 18 and pocket 26 is rotated such that open side 34 is caused to face toward the concave edge of the shoulder strap described above. At this point all of top surface 8 is on the interior of the folded lounge A and pocket 26 and its contents are on the exterior of the folded lounge A.

Finally, folding legs E and F, hingedly attached to center portion D, are folded inwardly and placed in contact with stationary center portion D. By this action lounge A, the cover of this invention, bag 36, pocket 26 and the contents thereof may be conveniently carried by means of shoulder strap 50 which, as explained above, now protrudes outwardly from folded lounge A. In the folded position, cloth clamps 58 and 62 are in a position to be removably fastened to the transverse edge joining the foot end and the trunk section of the cover to thereby retain the lounge in the folded position as it is being carried or otherwise transported.

Having thus described the invention, that which is claimed is:

1. A flexible bag for a folding lounge having a center section and two adjacent folding sections:

said bag being comprised of a first rectangular sleeve having two closed longitudinal sides, one closed transverse side and a first open side, a second rectangular sleeve having two closed longitudinal sides one closed transverse side and a second open side, wherein said first open side faces said second open side, a rectangular trunk intermediate said first rectangular sleeve and said second rectangular sleeve and a semi-circular loop directly attached to said second rectangular sleeve at said second open side;

said first rectangular sleeve comprises a first top layer of flexible material overlying a first bottom layer of flexible material attached each to the other at three edges along corresponding length dimensions and along one corresponding width dimension to thereby form said first rectangular sleeve;

said second rectangular sleeve comprises a second top layer of flexible material overlying a second bottom layer of flexible material attached each to the other at three edges along corresponding length dimensions and along one corresponding width dimension to thereby form said second rectangular sleeve;

said rectangular trunk comprises a layer of flexible material attached to the edge or said first top layer adjacent said first open side along a corresponding width dimension and to the edge of said second top layer adjacent said second open side along the opposite corresponding width dimension; and said semi-circular loop is formed by directly fastening each end of a rectangular strap to said second bottom layer adjacent the longitudinal edges of said second open side at the points where said second bottom layer and said second top layer are attached to define said second open side.

2. The bag of claim 1 wherein said first bottom layer of flexible material has attached thereto a pocket having three closed sides and one outwardly facing open side, said pocket being comprised of a net material attached to said first bottom layer of flexible material along each common length dimension and each common inner width dimension.

3. The bag of claim 1 wherein said rectangular trunk has attached thereto along at least one longitudinal edge thereof a second bag having at least one compartment, wherein said second bag is comprised of an outside layer of flexible material attached to an inside layer of flexible material along each transverse edge and a longitudinal edge to thereby form said second bag having three closed sides and one open side adjacent to said rectangular trunk.

4. The bag of claim 1 wherein said first rectangular sleeve has attached thereto, at said closed transverse side, one end of at least one rectangular strap, wherein a clamp is attached to said strap at the other end thereof.

5. A bag for a folding lounge having a center section and two adjacent folding sections:

said bag being comprised of a first rectangular sleeve, a second rectangular sleeve and a rectangular trunk intermediate said first rectangular sleeve and said second rectangular sleeve, wherein said first rectangular sleeve is comprised of a first top flexible layer overlying a first bottom flexible layer and said second rectangular sleeve is comprised of a second top flexible layer overlying a second bottom flexible layer;

said first top flexible layer and said first bottom flexible layer are attached each to the other at three edges along corresponding length dimensions and along one corresponding width dimension to thereby form said first rectangular sleeve having three connected sides and a first open side;

said second top flexible layer and said second bottom flexible layer are attached each to the other at three edges along corresponding length dimensions and along one corresponding width dimension to thereby form said second rectangular sleeve having three connected sides and a second open side;

said second bottom flexible layer has directly attached thereto a semi-circular loop, said semi-circular loop being formed by directly fastening, adjacent said second open side, each end of a rectangular strap to respective points of intersection of each said end with each length dimension and the width dimension of said second bottom flexible layer;

said rectangular trunk is attached, along a corresponding width dimension, to the edge of said first top flexible layer and to the edge of said second top flexible layer adjacent said first open side and said second open side, respectively, of said first rectangular sleeve and said second rectangular sleeve to thereby form said bag.

6. The bag of claim 5 wherein said first top flexible layer, said second top flexible layer, said first bottom flexible layer, said second bottom flexible layer and said trunk are made of a material which is water repellent, mildew resistant, color fast, and fade resistant and is characterized by high tensile strength, satisfactory scratch and tear resistance, is durable and has low porosity and low permeability.

7. The bag of claim 6 wherein said flexible material is a fabric made from the group consisting of nylon thread having a weight in the range of from about 70 to about 500 denier, 7 to 14.5 ounce cotton cloth, oxford cloth, canvas cloth and blends thereof.

8. The bag of claim 7 wherein said flexible material is coated with a polymeric material.

9. The bag of claim 8 wherein said first bottom flexible layer of said first rectangular sleeve has attached thereto a pocket having three closed sides and one outwardly facing open side, said pocket being comprised of a net material attached to said first bottom flexible layer along each common length dimension and each common inner width dimension.

10. The bag of claim 9 wherein said net material of said pocket is comprised of an open web construction whereby air may circulate through said pocket to facilitate drying of any contents of said pocket which may be damp or wet.

11. A cover for a lounge structure having a first folding portion, a second folding portion and a stationary center portion intermediate and hingedly attached to said first and said second folding portions:

said cover being comprised of a first end sleeve section, a second end sleeve section and a trunk section intermediate said first end sleeve section and said second end sleeve section:

wherein said first end sleeve section is comprised of a first rectangular top flexible layer which corresponds with, overlies and is attached to a first rectangular bottom flexible layer along each common longitudinal edge and each common outside transverse edge to thereby form said first end sleeve section having a first inner transverse edge and a first inwardly facing open side adjacent to said first inner transverse edge, said second end sleeve section is comprised of a second rectangular top flexible layer which corresponds with, overlies and is attached to a second rectangular bottom flexible layer along each common longitudinal edge and each common outside transverse edge to thereby form said second end sleeve section having a second inner transverse edge and a second inwardly facing open side adjacent to said second inner transverse edge and further;

wherein a semi-circular loop is directly attached to said second rectangular bottom flexible layer on said bottom surface of said cover, said semi-circular loop being formed by directly fastening, adjacent said second inwardly facing open side, each end of a rectangular strap to respective points of intersection of each said end with each length dimension and the width dimension of said second rectangular bottom flexible layer;

wherein said first end sleeve section, said second end sleeve section and said trunk section are connected to form said cover having a top surface and a bottom surface and further;

wherein said trunk section is comprised of a single rectangular flexible layer wherein one transverse edge of said trunk section is attached to said first inner transverse edge and the other transverse edge of said trunk section is attached to said second inner transverse edge whereby said first rectangular top flexible layer, said second rectangular top flexible layer and said rectangular flexible layer of said trunk section cooperate to form said top surface of said cover.

12. The cover of claim 11 wherein said outside transverse edge of said first end sleeve section has attached thereto one end of at least one rectangular strap, wherein a clamp is attached to said strap at the other end thereof.

13. The cover of claim 12 wherein a net material is attached to said bottom surface of said cover on said first bottom flexible layer, said net material being attached to said first bottom flexible layer along each common longitudinal edge and each common inner transverse edge to thereby form a pocket having three closed sides and one outwardly facing open side.

14. The cover of claim 13 wherein said trunk section has attached thereto along at least one longitudinal edge thereof a rectangular bag having at least one compartment, wherein said bag is comprised of an outside layer of flexible material attached to an inside layer of flexible material along each transverse edge and a longitudinal edge to thereby form said bag having three closed sides and one open side adjacent to said trunk section.

15. A bag for a lounge chair and a lounge-chair frame having a first folding portion, a second folding portion and a stationary center portion intermediate and hingedly attached to said first and said second folding portions:

said bag being a rectangular article comprised of a first sleeve section, a second sleeve section and a trunk section intermediate said first sleeve section and said second sleeve section wherein said first sleeve section, said second sleeve section and said trunk section are connected to form said rectangular article having a top surface and a bottom surface:

said first sleeve section is comprised of a first rectangular top layer of flexible material and a first rectangular bottom layer of flexible material wherein said first rectangular top layer corresponds with, overlies and is fixedly attached to said first rectangular bottom layer along each longitudinal edge and each outside transverse edge to thereby form said first sleeve section having a first inwardly facing open side adjacent to the inner transverse edge of said first rectangular top layer of flexible material;

said second sleeve section is comprised of a second rectangular top layer of flexible material and a second rectangular bottom layer of flexible material wherein said second rectangular top layer corresponds with, overlies and is fixedly attached to said second rectangular bottom layer along each longitudinal edge and each outside transverse edge to thereby form said second sleeve section having a second inwardly facing open side adjacent to the inner transverse edge of said second rectangular top layer of flexible material;

said trunk section is comprised of a rectangular flexible material wherein a first transverse edge of said trunk section is fixedly attached to said inner transverse edge of said first rectangular top layer of flexible material of said first sleeve section and a second transverse edge of said trunk section is fixedly attached to said inner transverse edge of said second rectangular top layer of flexible material of said second sleeve section, wherein said first rectangular top layer of flexible material, said second rectangular top layer of flexible material and said trunk section cooperate to form said top surface of said bag.

said second rectangular bottom layer of flexible material has directly attached thereto a semi-circular loop, said semi-circular loop being formed by directly fastening, adjacent said second open side, each end of a rectangular strap to respective points of intersection of each said end with each length dimension and the width dimension of said second rectangular bottom layer of flexible material;

said first rectangular bottom layer of flexible material has attached thereto a pocket having three closed sides and one outwardly facing open side, said pocket being comprised of a net material attached to said first rectangular bottom layer of flexible material along each common length dimension and each common inner width dimension;

said trunk section has attached thereto along at least one longitudinal edge thereof a second bag having at least one compartment, wherein said second bag is comprised of an outside layer of flexible material attached to an inside layer of flexible material along each transverse edge and a longitudinal edge to thereby form said second bag having three closed sides and one open side adjacent to said trunk section; and said first bottom layer of flexible material has attached thereto, at said outside transverse edge, one end of at least one rectangular strap, wherein a clamp is attached to said strap at the other end thereof.

* * * * *